US007624897B2

(12) United States Patent
Bloc

(10) Patent No.: US 7,624,897 B2
(45) **Date of Patent: *Dec. 1, 2009**

(54) SIMPLIFIED AIRLESS DISPENSING PUMP FOR LIQUID PRODUCT

(75) Inventor: Richard Bloc, Derchigny-Graincourt (FR)

(73) Assignee: Rexam Dispensing Systems S.A.S. (FR)

( * ) Notice: Subject to any disclaimer, the term of this patent is extended or adjusted under 35 U.S.C. 154(b) by 375 days.

This patent is subject to a terminal disclaimer.

(21) Appl. No.: 11/567,566

(22) Filed: Dec. 6, 2006

(65) Prior Publication Data

US 2007/0108234 A1 May 17, 2007

Related U.S. Application Data

(63) Continuation of application No. PCT/FR2005/001391, filed on Jun. 7, 2005.

(51) Int. Cl.
*B65D 37/00* (2006.01)

(52) U.S. Cl. ..... 222/207; 222/211; 222/321.7; 222/383.1; 239/323; 239/328

(58) Field of Classification Search ..... 222/207, 222/209, 211–214, 321.7, 380, 383.1; 239/323, 239/328, 331, 463, 476, 482, 486, 491, 492–493, 239/569–571

See application file for complete search history.

(56) References Cited

U.S. PATENT DOCUMENTS

| | | | | |
|---|---|---|---|---|
| 3,075,708 A | | 1/1963 | Cooprider | 239/490 |
| 3,752,366 A | | 8/1973 | Lawrence, Jr. | 222/207 |
| 4,201,317 A | * | 5/1980 | Aleff | 222/207 |
| 4,336,895 A | * | 6/1982 | Aleff | 222/207 |
| 4,863,070 A | * | 9/1989 | Andris | 222/207 |
| 5,014,881 A | | 5/1991 | Andris | 222/207 |
| 5,224,627 A | * | 7/1993 | Weag | 222/135 |
| 5,238,156 A | * | 8/1993 | Andris | 222/207 |
| 5,544,789 A | * | 8/1996 | Gillingham | 222/153.13 |
| 7,328,856 B2 | * | 2/2008 | Bloc et al. | 239/328 |

FOREIGN PATENT DOCUMENTS

| | | |
|---|---|---|
| FR | 2 835 513 | 8/2003 |

OTHER PUBLICATIONS

International Search Report, Nov. 1, 2005, 2 pages.

* cited by examiner

*Primary Examiner*—Frederick C. Nicolas
(74) *Attorney, Agent, or Firm*—St. Onge Steward Johnston & Reens LLC

(57) ABSTRACT

An airless dispensing pump for liquid products including a push button with a spray nozzle which communicates with a network of channels that is provided locally on the wall of an internal truncated-cone-shaped bore, and a housing. An upper part of the housing includes a dosing cell having an elastically-deformable wall, which is equipped with an intake valve and topped with a rigid collar for fixing same inside the bore of the aforementioned button. Moreover, the outer periphery of the collar has an inclined face which defines a swirl chamber opposite the above-mentioned network, while the inner periphery thereof is quipped with a passage to the chamber.

12 Claims, 3 Drawing Sheets

SIMPLIFIED AIRLESS DISPENSING PUMP FOR LIQUID PRODUCT

CROSS-REFERENCE TO RELATED APPLICATIONS

The present application is a continuation of pending International patent application PCT/FR2005/001391 filed on Jun. 7, 2005 which designates the United States and claims priority from French patent application 0406276 filed on Jun. 10, 2004, the content of which is incorporated herein by reference.

FIELD OF THE INVENTION

The present invention relates to a pump for an airless dispenser of liquid products, and more particularly for a dispenser which dispenses small doses of cosmetic products, perfumes or pharmaceutical products.

BACKGROUND OF THE INVENTION

Dispensers of this type are generally equipped with traditional pumps consisting of a body which delimits a dosing chamber enclosing a piston and a return spring.

However, the various functions of the pump such as, in particular, sealing, compression, elastic return of the piston, dosing, are performed by separate parts which are often made with different materials, some of which have been found to be incompatible with the products in that they degrade the properties of the product over a prolonged residence time or time of contact with said product.

In addition, both the manufacture and assembly of these numerous parts are delicate operations, in particular when said parts are of small size.

The object of the present invention is to solve these problems in a satisfactory manner.

SUMMARY OF THE INVENTION

This object is achieved, according to the invention, by means of a pump which is characterised in that it comprises:

- a push button comprising a spraying nozzle which communicates with a network of channels formed locally on the wall of a frustoconical internal bore, and
- a body which is provided, in its upper part, with a dosing cell which has an elastically deformable wall and is equipped on the one hand with an intake valve and is surmounted on the other hand by a rigid collar for fixing it in the bore of said button, said collar having on its outer periphery an inclined face which delimits a vortex chamber opposite said network, and having on its inner periphery a passage to said chamber.

According to one advantageous feature, this pump comprises an axial rod, borne by said button, which extends through said body and the lower part of which, provided with at least one longitudinal channel, is engaged in a sliding manner in a supply duct which extends said cell while forming the intake valve.

According to another feature, the upper edge of said duct is provided with an annular sealing lip which comes into contact with said rod.

According to a first variant, said rod is formed in a single piece with said button. In this case, said inclined face of the collar of the cell forms with the wall of the bore of the button a peripheral escape groove which is delimited radially by a flexible lip forming a valve.

According to another variant, said rod is an independent piece which is provided, in its upper part, with a central cavity designed to receive a centring pin borne by said button and with a sealing ring which comes to bear against the inner periphery of the collar of said cell while forming an escape valve.

Advantageously, said ring is provided with a lower rib which comes to bear in a sealing manner against an annular flange formed on the inner periphery of said collar.

In this variant, said ring preferably has teeth which cooperate with notches formed on the inner wall of the bore of the button.

According to yet another feature, said body comprises, in its lower part, a bushing for fixing it to a reservoir.

Preferably, said bushing comprises a support shoulder for supporting it on said reservoir and at least one spigot which forms a lower stop for said collar during the deformation of said cell.

According to another feature, said button comprises a lateral skirt, inside which said body is housed.

According to one variant, said cell is produced in the form of a cylindrical bellows-type pocket.

It is also possible to provide that said body is extended downwards by a withdrawal tube connected to said intake valve.

The pump of the invention makes it possible to combine the functional elements into a very small number of parts or even into the body of the pump itself.

The axial rod performs the function of a valve with regard to both intake and escape of the product, which ensures a high level of sealing and also good synchronisation of the opening and closing phases.

This pump moreover does not contain any metallic element and can be made solely from plastic which is compatible with the biological and/or chemical properties of the product.

Furthermore, assembly of the small number of constituent parts and, in particular, the fixing of the button to the body is possible in particular by virtue of the cooperation between the spigots, which form strengthening reinforcements, and the collar.

Moreover, due to the symmetry of revolution of the body and of the rod, this assembly operation can easily be automated without it being necessary to index the parts with respect to one another.

BRIEF DESCRIPTION OF THE DRAWINGS

The invention will be better understood from reading the following description which is given with reference to the drawings, in which.

DETAILED DESCRIPTION OF THE INVENTION

Figure 3:
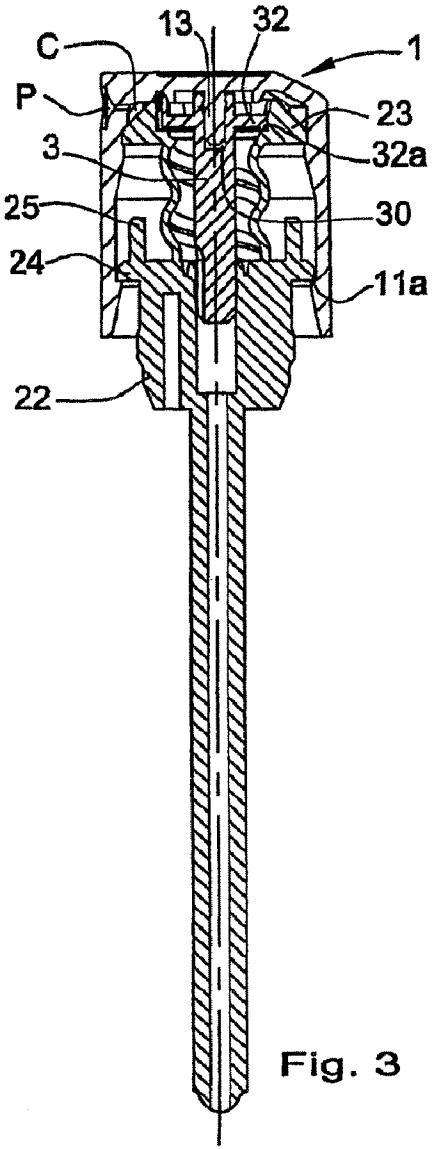
FIGS. 2 and 3 show sectional views of two variant embodiments of the pump of the invention.

The pump shown in the figures is designed for the airless dispensing of perfume samples, cosmetic products or even of small doses of liquid pharmaceutical products.

These products are packaged in a reservoir R which may be made of glass or of plastic, on which the pump of the invention is mounted.

This pump comprises a push button 1 provided with a spraying nozzle P. The nozzle P comprises an ejection orifice which communicates with a network of channels C formed locally on the wall of a frustoconical internal bore 10 which can be seen in particular in FIG. 3B.

The pump of the invention also comprises a body 2 housed inside a lateral skirt 11 borne by the button 1. This body is provided, in its upper part, with a dosing cell 20, the wall of which is elastically deformable so as to be able to return to its initial shape after having been compressed.

In the variants shown here in the figures, the cell 20 is produced in the form of a cylindrical bellows-type pocket which is equipped on the one hand in the lower part with an intake valve and is surmounted on the other hand by a rigid collar 23 for fixing it in the bore 10 of the button 1.

The collar 23 has on its outer periphery an inclined face 23*a* which delimits a vortex chamber opposite the network of channels C, said vortex chamber opening to the outside via the nozzle P.

Furthermore, the collar 23 has on its inner periphery a passage for the product from the cell 20 to the vortex chamber, formed by at least one upper peripheral portion 12.

The intake valve consists of an axial rod 3 which is borne by the button 1 and which extends through the body 2. The rod 3 moves with the button 1.

To this end, the lower part of the rod 3 is provided with at least one longitudinal channel 31 and is engaged in a sliding manner in a supply duct 21 which extends the cell 20 downwards.

In the embodiment shown in the figures, the duct 21 is connected to a withdrawal tube 4, the lower end of which is immersed in the product.

The upper edge of the duct 21 is provided with an annular sealing lip 21*a* which comes into contact radially with the rod 3 above the level of the channel 31.

The body 2 also comprises, in its lower part, a bushing 22 for fixing it in or on the neck of the reservoir R.

Figure 2:
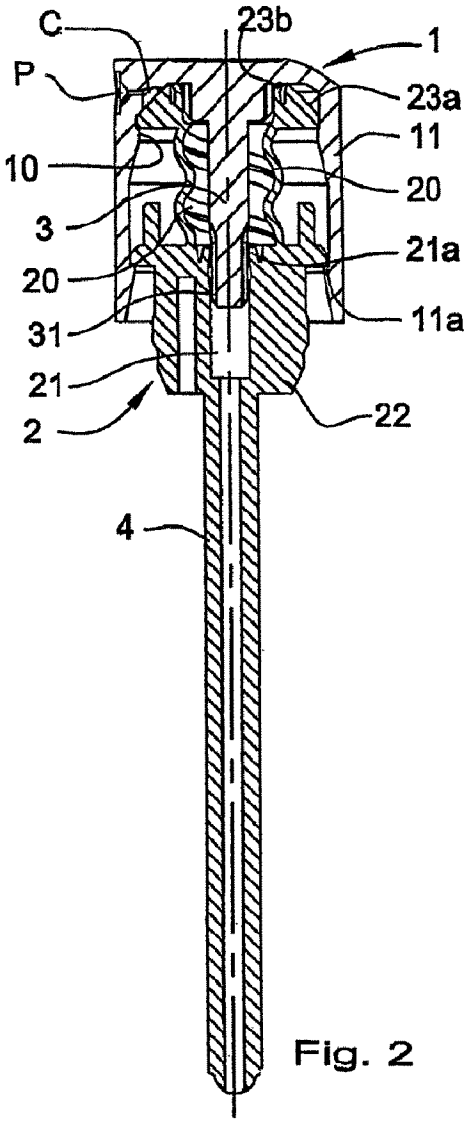
Figure 1:
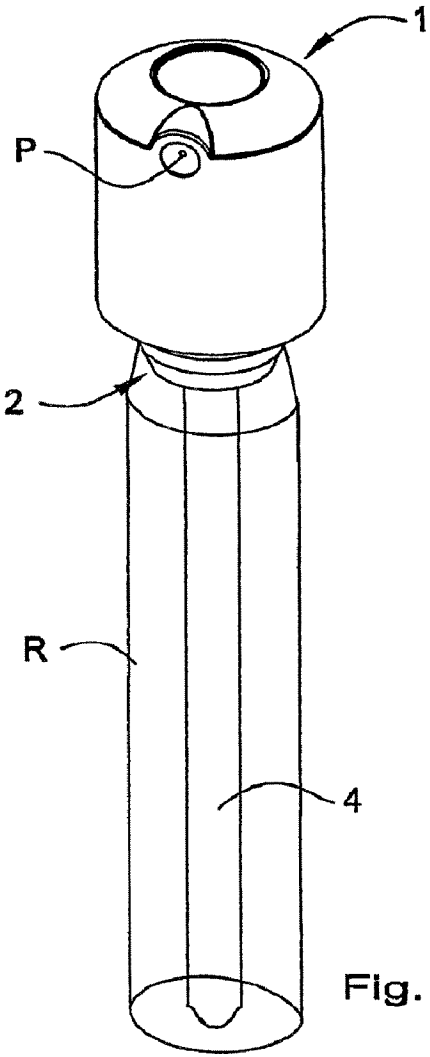
FIG. 1 shows a profile view of one embodiment of the pump of the invention mounted on a product reservoir.
Figure 3B:
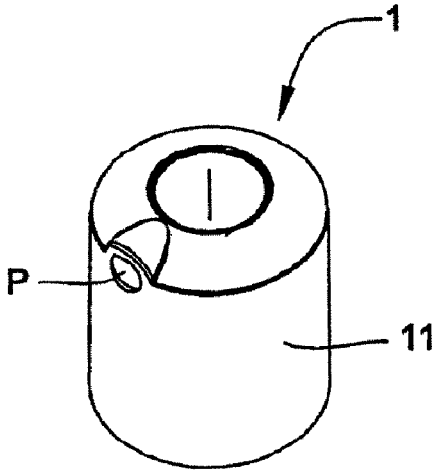
FIG. 3B shows a detailed view from below of the push button used in the variant of FIG. 3, FIGS. 4A to 4E show the successive phases of operation of the pump of FIG. 3.
Figure 3B:
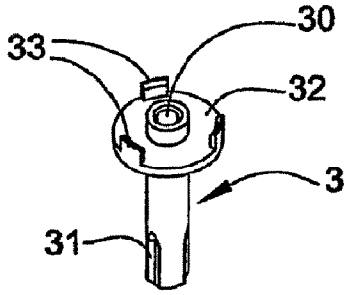
Figure 3B:
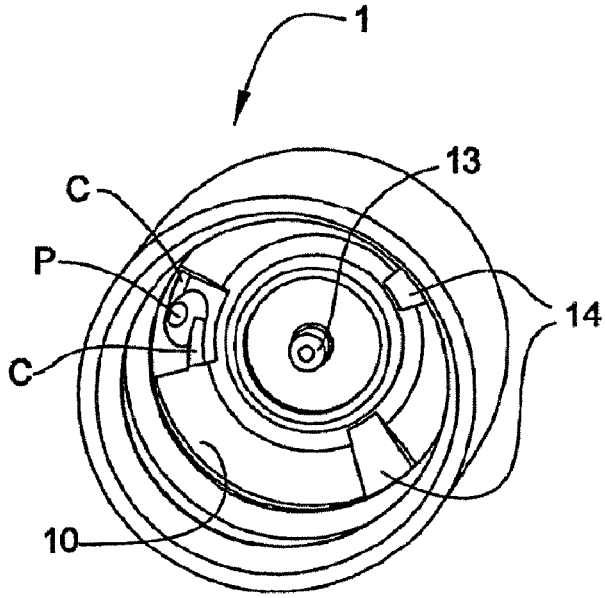

To this end, the bushing 22 is produced either in the form of a stopper which is designed to be introduced with radial locking into the interior of the neck (FIGS. 2 and 3, half-views on the right) or in the form of a capsule which clips onto the outside of the neck (FIGS. 2 and 3, half-views on the left).

Figures 4A, 4B, 4C, 4D, 4E:
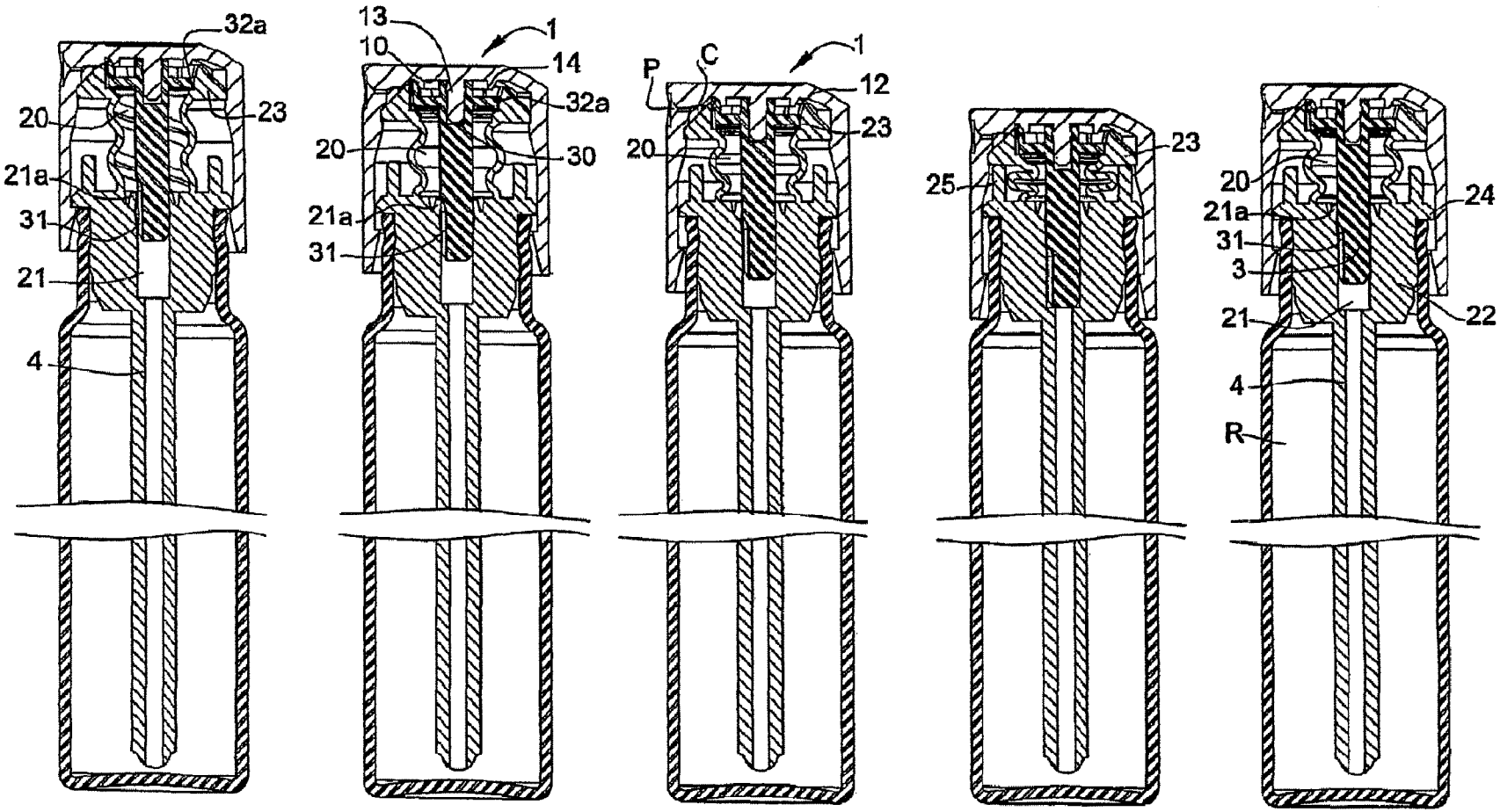

In all cases, the bushing 22 comprises a support shoulder 24 for supporting it on the neck of the reservoir R and at least one spigot 25 which forms a lower stop for the collar 23 during the deformation of the cell 20 (see FIG. 4D).

The lateral skirt 11 of the button 1 has, on its inner wall, a peripheral protrusion 11*a* which ensures that the shoulder 24 clips in and is retained and therefore holds the body 2 inside the button 1.

In the variant of FIG. 2, the rod 3 is formed in a single piece with the button 1. In this case, the inclined face 23*a* of the collar 23 forms with the wall of the bore 10 a peripheral product escape groove which is delimited radially by a flexible lip 23*b* forming a valve.

During the dispensing operation, the resistance of the lip 23*b* yields when, by deformation of the cell 20, the pressure within the product reaches a certain threshold. The product is then expelled towards the vortex chamber via the peripheral groove.

In the variant of FIG. 3, the rod 3 is produced in the form of an independent piece which is provided, in its upper part, with a central cavity 30 designed to receive, with slight axial play, a centring pin 13 borne by the button 1. The rod 3 also carries a sealing ring 32 which forms an escape valve.

Figure 3A:
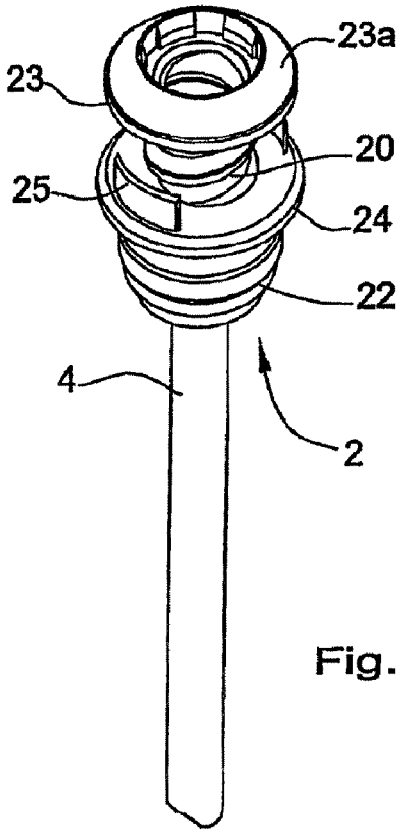
FIG. 3A shows an exploded view of the variant of FIG. 3.

The ring 32 comes to bear in a sealed manner, at the bottom, against the inner periphery of the collar 23 which has, to this end, a flange 23*c* which can be seen in particular in FIG. 3A. Preferably, the inner face of the ring 32 will be provided with an annular rib 32*a* which makes contact with the flange 21*b*.

The ring 32 has teeth 33 (three in the present case) with a bevelled end 33*a* which cooperate with corresponding notches 14 formed on the inner wall of the bore 10. The notches 14 have an inclined outer face which allows the guided displacement of the end of the teeth 33 when bearing against the button.

If necessary, the teeth 33 may have a capacity for elastic deformation or elastic flexion within the relevant force range.

The operation of the pump of the invention will now be described with reference to FIGS. 4A to 4E applied to the variant of FIGS. 3 and 3A.

FIG. 4A corresponds to the rest position of the dispenser.

In this position, the product is packaged in a completely sealed manner, the ring 32 resting with its lower rib 32*a* bearing in a sealed manner against the inner flange 23*c* of the collar 23 so as to close off the cell 20 in the top part.

In parallel, at the bottom, the intake valve is open due to the fact that the channel 31 of the rod 3 is located opposite the lip 21*a*, thus forming a means of communication between the cell 20, the duct 21 and the tube 4.

However, the product contained in the cell 20 remains in suspension.

FIG. 4B corresponds to the initial dispensing phase, with the user starting to exert manual pressure on the upper face of the button 1 so as to compress the cell 20.

The first effects resulting from this force are the downward movement of the button 1, the taking-up of the axial play between the pin 13 and the cavity 30 and the sliding of the bevelled faces 33*a* on the notches 14. This phase continues until the teeth 33 and/or the upper end of the rod 3 come into abutment in the top part against the end of the bore 10. This displacement of the rod 3 relative to the collar 23 brings about opening of the escape valve, by moving the lower rib 32*a* away from the flange 23*c*.

The upward travel of the rod 3 and thus the rate of opening of the escape valve can be increased if necessary by giving the teeth 33 a certain flexibility. The rod 3 is rapidly pressed down until the upper edge of the channel 31 passes below the level of the lip 21*a*, thus closing the intake valve and isolating a dose of product in the cell 20.

FIG. 4*c* corresponds to the phase of spraying the dose of product.

Continuing to press manually on the button 1 brings about deformation of the cell 20 and compression of the product which escapes to the outside via the escape valve by exerting a thrust on the lower face of the ring 23, then via the upper peripheral passage 12, the network of channels C, the vortex chamber and finally the nozzle P.

FIG. 4D corresponds to the end of spraying.

The lower face of the collar 23 of the cell 20 is then in abutment at the bottom against the spigots 25, which corresponds to the deformation limit of said cell and to a volume of expelled product equivalent to one dose. At the same time, the escape valve recloses.

FIG. 4E corresponds to the return of the pump to its rest position. The release of pressure on the button 1 brings about expansion of the cell 20 in the manner of a return spring.

This expansion of the cell 20 causes the rod 3 to move upwards again, while keeping the escape valve in the closed position and intaking product from the reservoir R via the tube 4 and the duct 21.

The filling of the dosing cell 20 is achieved by an intake of product from the time the channel 31 passes the level of the lip 21*a* of the intake valve until the protrusion 11*a* of the button 1 abuts against the shoulder 24 of the bushing 22 of the body 2.

What is claimed is:

1. A pump for an airless dispenser of liquid products, characterised in that it comprises:

a push button comprising a spraying nozzle which communicates with a network of channels formed locally on a wall of a frustoconical internal bore;

a body which is provided, in an upper part of said body, with a dosing cell which has an elastically deformable wall and is equipped with an intake valve and is surmounted by a rigid collar for fixing said body in the bore of said push button, said collar having on outer periphery of said collar an inclined face which delimits a vortex chamber opposite said network, and having on an inner periphery of said collar a passage to said chamber; and an axial rod, borne by said push button, which extends through said body and a lower part of which, provided with at east one longitudinal channel, is engaged in a sliding manner in a supply duct which extends said dosing cell while forming the intake valve.

2. The pump according to claim 1, characterised in that the upper edge of said supply duct is provided with an annular sealing lip which comes into contact with said axial rod.

3. The pump according to claim 1, characterised in that said axial rod is formed in a single piece with said push button.

4. The pump according to claim 3, characterised in that said inclined face of the collar of the dosing cell forms with the wall of the bore of the push button a peripheral escape groove which is delimited radially by a flexible lip forming a valve.

5. The pump according to claim 1, characterised in that said axial rod is an independent piece which is provided, in an upper part of said axial rod, with a central cavity designed to receive a centring pin borne by said push button and with a sealing ring which comes to bear against the inner periphery of the collar of said dosing cell while forming an escape valve.

6. The pump according to claim 5, characterised in that said sealing ring is provided with a lower rib which comes to bear in a sealing manner against an annular flange formed on the inner periphery of said collar.

7. The pump according to claim 5, characterised in that said sealing ring has teeth which cooperate with notches formed on the wall of the bore of the push button.

8. The pump according to claim 1, characterised in that said body comprises, in a lower part of said body, a bushing for fixing it to a reservoir.

9. The pump according to claim 8, characterised in that said bushing comprises a support shoulder for supporting said bushing on said reservoir and at least one spigot which forms a lower stop for said collar during a deformation of said dosing cell.

10. The pump according to claim 1, characterised in that said push button comprises a lateral skirt, inside which said body is housed.

11. The pump according to claim 1, characterised in that said dosing cell is produced in the form of a cylindrical bellows-type pocket.

12. The pump according to claim 1, characterised in that said body is extended downwards by a withdrawal tube connected to said intake valve.

* * * * *